US008109331B2

(12) United States Patent
Lynde et al.

(10) Patent No.: US 8,109,331 B2
(45) Date of Patent: Feb. 7, 2012

(54) SLICKLINE CONVEYED DEBRIS MANAGEMENT SYSTEM

(75) Inventors: Gerald D. Lynde, Houston, TX (US); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 269 days.

(21) Appl. No.: 12/423,044

(22) Filed: Apr. 14, 2009

(65) Prior Publication Data

US 2010/0258296 A1 Oct. 14, 2010

(51) Int. Cl.
*E21B 27/00* (2006.01)
*E21B 37/00* (2006.01)

(52) U.S. Cl. ..... 166/105.3; 166/177.6; 166/311

(58) Field of Classification Search ..... 166/311, 166/99, 105.1, 105.3, 105.4
See application file for complete search history.

(56) References Cited

U.S. PATENT DOCUMENTS

| | | | | |
|---|---|---|---|---|
| 1,852,920 | A | 4/1932 | Combs | |
| 3,981,364 | A | 9/1976 | Warner et al. | |
| 4,083,401 | A | 4/1978 | Rankin | |
| 4,392,377 | A | 7/1983 | Rankin | |
| 4,476,925 | A | 10/1984 | Cox | |
| 4,671,359 | A | 6/1987 | Renfro | |
| 4,694,901 | A * | 9/1987 | Skinner | 166/222 |
| 4,921,577 | A * | 5/1990 | Eubank | 166/311 |
| 4,924,940 | A | 5/1990 | Burroughs et al. | |
| 5,050,682 | A * | 9/1991 | Huber et al. | 166/377 |
| 5,095,993 | A * | 3/1992 | Huber et al. | 166/382 |
| 5,280,825 | A * | 1/1994 | Cholet | 166/311 |
| 5,295,537 | A * | 3/1994 | Trainer | 166/105.1 |
| 5,314,018 | A * | 5/1994 | Cobb | 166/265 |
| 5,318,128 | A | 6/1994 | Johnson et al. | |
| 5,327,974 | A | 7/1994 | Donovan et al. | |
| 5,392,856 | A | 2/1995 | Broussard, Jr. et al. | |
| 5,553,669 | A | 9/1996 | Trainer | |
| RE35,454 | E * | 2/1997 | Cobb | 166/265 |
| 5,649,603 | A | 7/1997 | Simpson et al. | |
| 5,662,167 | A * | 9/1997 | Patterson et al. | 166/265 |
| 5,810,081 | A * | 9/1998 | Cobb et al. | 166/105.3 |
| 5,819,848 | A * | 10/1998 | Rasmuson et al. | 166/250.15 |
| 6,026,911 | A | 2/2000 | Angle et al. | |

(Continued)

FOREIGN PATENT DOCUMENTS

WO 9324728 12/1993

OTHER PUBLICATIONS

Haughton, D.B., et al., "Reliable and Effective Downhole Cleaning System for Debris and Junk Removal", SPE 101727, Sep. 2006. 1-9.

(Continued)

*Primary Examiner* — Jennifer H Gay
(74) *Attorney, Agent, or Firm* — Steve Rosenblatt

(57) ABSTRACT

A wellbore cleanup tool is run on slickline. It has an onboard power supply and circulation pump. Inlet flow is at the lower end into an inlet pipe that keeps up fluid velocity. The inlet pipe opens to a surrounding annular volume for sand containment and the fluid continues through a screen and into the pump for eventual exhaust back into the water in the wellbore. A modular structure is envisioned to add debris carrying capacity. Various ways to energize the device are possible. Other tools run on slickline are described such as a cutter, a scraper and a shifting tool.

8 Claims, 7 Drawing Sheets

U.S. PATENT DOCUMENTS

| | | | | |
|---|---|---|---|---|
| 6,059,030 | A | 5/2000 | Celestine | |
| 6,062,315 | A | 5/2000 | Reinhardt | |
| 6,189,617 | B1 | 2/2001 | Sorhus et al. | |
| 6,189,621 | B1 | 2/2001 | Vail, III | |
| 6,196,319 | B1 | 3/2001 | Henskens et al. | |
| 6,276,452 | B1 * | 8/2001 | Davis et al. | 166/298 |
| 6,343,649 | B1 * | 2/2002 | Beck et al. | 166/250.01 |
| 6,359,569 | B2 * | 3/2002 | Beck et al. | 340/856.3 |
| 6,397,946 | B1 | 6/2002 | Vail, III | |
| 6,405,798 | B1 | 6/2002 | Barrett et al. | |
| 6,464,012 | B1 | 10/2002 | Strickland | |
| 6,481,505 | B2 * | 11/2002 | Beck et al. | 166/387 |
| 6,497,280 | B2 * | 12/2002 | Beck et al. | 166/250.07 |
| 6,588,505 | B2 * | 7/2003 | Beck et al. | 166/250.17 |
| 6,607,607 | B2 | 8/2003 | Walker et al. | |
| 6,619,390 | B1 | 9/2003 | Kellett, III | |
| 6,695,058 | B1 * | 2/2004 | French | 166/312 |
| 6,729,407 | B2 | 5/2004 | Stoesz | |
| 6,745,839 | B1 | 6/2004 | Simpson | |
| 6,920,936 | B2 | 7/2005 | Sheiretov et al. | |
| 6,923,871 | B2 * | 8/2005 | Walker et al. | 134/24 |
| 6,945,330 | B2 | 9/2005 | Wilson et al. | |
| 6,978,841 | B2 * | 12/2005 | Hoffman et al. | 166/381 |
| 7,051,810 | B2 | 5/2006 | Clemens et al. | |
| 7,080,701 | B2 | 7/2006 | Bloom et al. | |
| 7,111,677 | B2 | 9/2006 | St. Clair | |
| 7,121,343 | B2 | 10/2006 | Telfer | |
| 7,143,843 | B2 | 12/2006 | Doering et al. | |
| 7,152,680 | B2 | 12/2006 | Wilson et al. | |
| 7,182,025 | B2 | 2/2007 | Ghorbel et al. | |
| 7,188,675 | B2 * | 3/2007 | Reynolds | 166/311 |
| 7,222,682 | B2 | 5/2007 | Doering et al. | |
| 7,325,606 | B1 | 2/2008 | Vail, III et al. | |
| 7,377,283 | B2 * | 5/2008 | Walker et al. | 134/22.1 |
| 7,387,165 | B2 | 6/2008 | Lopez de Cardenas et al. | |
| 7,392,859 | B2 | 7/2008 | Mock et al. | |
| 7,472,745 | B2 * | 1/2009 | Lynde et al. | 166/99 |
| 7,607,497 | B2 | 10/2009 | Mock et al. | |
| 7,610,957 | B2 * | 11/2009 | Davis et al. | 166/99 |
| 7,655,096 | B2 * | 2/2010 | Walker et al. | 134/10 |
| 7,661,489 | B2 | 2/2010 | Fyfe | |
| 7,874,366 | B2 * | 1/2011 | Allcorn et al. | 166/311 |
| 7,878,242 | B2 | 2/2011 | Gray | |
| 2001/0013410 | A1 * | 8/2001 | Beck et al. | 166/65.1 |
| 2001/0013411 | A1 * | 8/2001 | Beck et al. | 166/65.1 |
| 2001/0042617 | A1 * | 11/2001 | Beck et al. | 166/65.1 |
| 2001/0043146 | A1 * | 11/2001 | Beck et al. | 340/855.8 |
| 2003/0173076 | A1 | 9/2003 | Sheiretov et al. | |
| 2003/0196952 | A1 | 10/2003 | Kampfen | |
| 2005/0034874 | A1 | 2/2005 | Guerrero et al. | |
| 2005/0126791 | A1 | 6/2005 | Barbee et al. | |
| 2005/0217861 | A1 | 10/2005 | Misselbrook | |
| 2005/0247488 | A1 | 11/2005 | Mock et al. | |
| 2005/0263325 | A1 | 12/2005 | Doering et al. | |
| 2006/0108117 | A1 | 5/2006 | Telfer | |
| 2006/0201716 | A1 | 9/2006 | Bloom et al. | |
| 2007/0251687 | A1 | 11/2007 | Martinez et al. | |
| 2007/0272411 | A1 | 11/2007 | Lopez de Cardenas et al. | |
| 2008/0029276 | A1 | 2/2008 | Templeton et al. | |
| 2008/0308318 | A1 | 12/2008 | Moore | |
| 2009/0008152 | A1 | 1/2009 | Mock et al. | |
| 2009/0045975 | A1 | 2/2009 | Evans et al. | |
| 2009/0200012 | A1 * | 8/2009 | Davis et al. | 166/99 |
| 2009/0301723 | A1 | 12/2009 | Gray | |
| 2010/0096187 | A1 | 4/2010 | Storm et al. | |
| 2010/0163251 | A1 | 7/2010 | Mock et al. | |
| 2010/0258289 | A1 * | 10/2010 | Lynde et al. | 166/55.7 |
| 2010/0258293 | A1 * | 10/2010 | Lynde et al. | 166/66 |
| 2010/0258296 | A1 * | 10/2010 | Lynde et al. | 166/105.1 |
| 2010/0258297 | A1 * | 10/2010 | Lynde | 166/105.1 |
| 2010/0258298 | A1 * | 10/2010 | Lynde et al. | 166/173 |
| 2010/0263856 | A1 | 10/2010 | Lynde et al. | |
| 2010/0288501 | A1 * | 11/2010 | Fielder et al. | 166/311 |
| 2011/0048702 | A1 | 3/2011 | Jacob | |
| 2011/0056692 | A1 * | 3/2011 | Lopez de Cardenas et al. | 166/305.1 |
| 2011/0162835 | A1 | 7/2011 | Gray | |

OTHER PUBLICATIONS

Connell, P, et al., Removal of Debris from Deepwater Wellbores Using Vectored Annulus Cleaning System Reduces Problems and Saves Rig Time, SPE 96440, Oct. 2005, 1-6.

Stragiotti, Stephen, et al., "Successful Milling and Removal of a Permanent Bridge Plug With Electric-Line Tractor-Conveyed Technology", SPE 121539, Mar. 2009, 1-7.

Li, J., et al., "Sand Cleanout with Coiled Tubing: Choice of Process, Tools, or Fluids?", SPE 113267, Jun. 2008, 1-.

TAM International Brochure; "TAM SlikPak Plus", http://www.tamintl.com/images/stories/pdfs/SlikPakPlus_Brochure.pdf; 4 pages, date unknown.

* cited by examiner

SLICKLINE CONVEYED DEBRIS MANAGEMENT SYSTEM

FIELD OF THE INVENTION

The field of this invention is tools run downhole preferably on cable and which operate with on board power to perform a downhole function and more particularly wellbore debris cleanup.

BACKGROUND OF THE INVENTION

It is a common practice to plug wells and to have encroachment of water into the wellbore above the plug. FIG. 1 illustrates this phenomenon. It shows a wellbore 10 through formations 12, 14 and 16 with a plug 18 in zone 16. Water 20 has infiltrated as indicated by arrows 22 and brought sand 24 with it. There is not enough formation pressure to get the water 20 to the surface. As a result, the sand 24 simply settles on the plug 18.

There are many techniques developed to remove debris from wellbores and a good survey article that reviews many of these procedures is SPE 113267 Published June 2008 by Li, Misselbrook and Seal entitled Sand Cleanout with Coiled Tubing: Choice of Process, Tools or Fluids? There are limits to which techniques can be used with low pressure formations. Techniques that involve pressurized fluid circulation present risk of fluid loss into a low pressure formation from simply the fluid column hydrostatic pressure that is created when the well is filled with fluid and circulated or jetted. The productivity of the formation can be adversely affected should such flow into the formation occur. As an alternative to liquid circulation, systems involving foam have been proposed with the idea being that the density of the foam is so low that fluid losses will not be an issue. Instead, the foam entrains the sand or debris and carries it to the surface without the creation of a hydrostatic head on the low pressure formation in the vicinity of the plug. The downside of this technique is the cost of the specialized foam equipment and the logistics of getting such equipment to the well site in remote locations.

Various techniques of capturing debris have been developed. Some involve chambers that have flapper type valves that allow liquid and sand to enter and then use gravity to allow the flapper to close trapping in the sand. The motive force can be a chamber under vacuum that is opened to the collection chamber downhole or the use of a reciprocating pump with a series of flapper type check valves. These systems can have operational issues with sand buildup on the seats for the flappers that keep them from sealing and as a result some of the captured sand simply escapes again. Some of these one shot systems that depend on a vacuum chamber to suck in water and sand into a containment chamber have been run in on wireline. Illustrative of some of these debris cleanup devices are U.S. Pat. No. 6,196,319 (wireline); U.S. Pat. No. 5,327,974 (tubing run); U.S. Pat. No. 5,318,128 (tubing run); U.S. Pat. No. 6,607,607 (coiled tubing); U.S. Pat. No. 4,671,359 (coiled tubing); U.S. Pat. No. 6,464,012 (wireline); U.S. Pat. No. 4,924,940 (rigid tubing) and U.S. Pat. No. 6,059,030 (rigid tubing).

The reciprocation debris collection systems also have the issue of a lack of continuous flow which promotes entrained sand to drop when flow is interrupted. Another issue with some tools for debris removal is a minimum diameter for these tools keeps them from being used in very small diameter wells. Proper positioning is also an issue. With tools that trap sand from flow entering at the lower end and run in on coiled tubing there is a possibility of forcing the lower end into the sand where the manner of kicking on the pump involves setting down weight such as in U.S. Pat. No. 6,059,030. On the other hand, especially with the one shot vacuum tools, being too high in the water and well above the sand line will result in minimal capture of sand.

What is needed is a debris removal tool that can be quickly deployed such as by slickline and can be made small enough to be useful in small diameter wells while at the same time using a debris removal technique that features effective capture of the sand and preferably a continuous fluid circulation while doing so. A modular design can help with carrying capacity in small wells and save trips to the surface to remove the captured sand. Other features that maintain fluid velocity to keep the sand entrained and further employ centrifugal force in aid of separating the sand from the circulating fluid are also potential features of the present invention. Those skilled in the art will have a better idea of the various aspects of the invention from a review of the detailed description of the preferred embodiment and the associated drawings, while recognizing that the full scope of the invention is determined by the appended claims.

One of the issues with introduction of bottom hole assemblies into a wellbore is how to advance the assembly when the well is deviated to the point where the force of gravity is insufficient to assure further progress downhole. Various types of propulsion devices have been devised but are either not suited for slickline application or not adapted to advance a bottom hole assembly through a deviated well. Some examples of such designs are U.S. Pat. Nos. 7,392,859; 7,325,606; 7,152,680; 7,121,343; 6,945,330; 6,189,621 and 6,397,946. US Publication 2009/0045975 shows a tractor that is driven on a slickline where the slickline itself has been advanced into a wellbore by the force of gravity from the weight of the bottom hole assembly.

SUMMARY OF THE INVENTION

A wellbore cleanup tool is run on slickline. It has an onboard power supply and circulation pump. Inlet flow is at the lower end into an inlet pipe that keeps up fluid velocity. The inlet pipe opens to a surrounding annular volume for sand containment and the fluid continues through a screen and into the pump for eventual exhaust back into the water in the wellbore. A modular structure is envisioned to add debris carrying capacity. Various ways to energize the device are possible. Other tools run on slickline are described such as a cutter, a scraper and a shifting tool.

DETAILED DESCRIPTION OF THE PREFERRED EMBODIMENT

Figure 1:
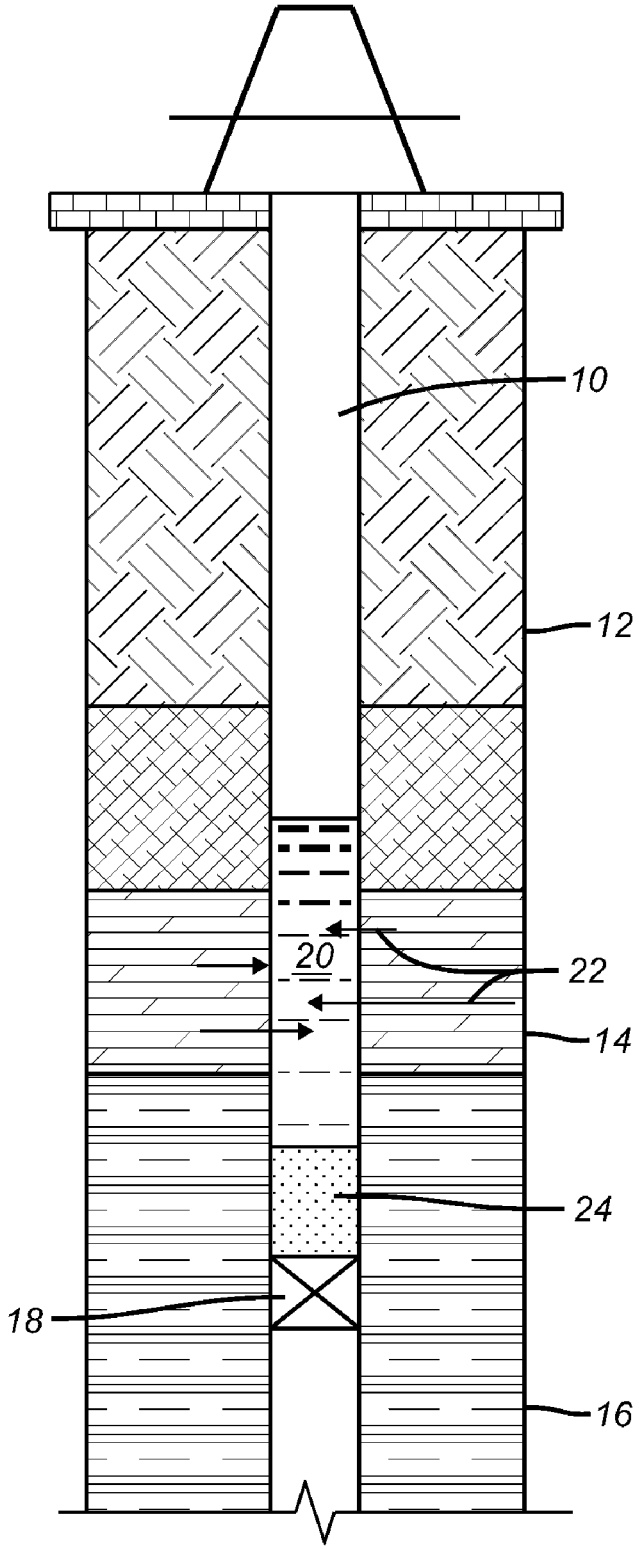
FIG. 1 is a section view of a plugged well where the debris collection device will be deployed.
Figure 2:
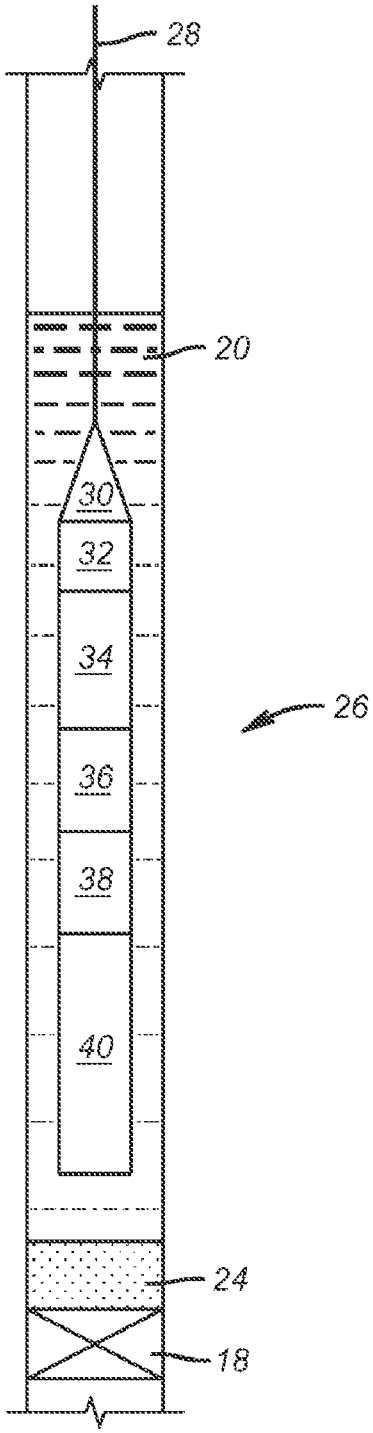
FIG. 2 is the view of FIG. 1 with the device lowered into position adjacent the debris to be removed.

FIG. 2 shows the tool 26 lowered into the water 20 on a slickline or non-conductive cable 28. The main features of the tool are a disconnect 30 at the lower end of the cable 28 and a control system 32 for turning the tool 26 on and off and for other purposes. A power supply, such as a battery 34, powers a motor 36, which in turn runs a pump 38. The modular debris removal tool 40 is at the bottom of the assembly.

While a cable or slickline 28 is preferred because it is a low cost way to rapidly get the tool 26 into the water 20, a wireline can also be used and surface power through the wireline can replace the onboard battery 34. The control system can be configured in different ways. In one version it can be a time delay energized at the surface so that the tool 26 will have enough time to be lowered into the water 20 before motor 36 starts running. Another way to actuate the motor 36 is to use a switch that is responsive to being immersed in water to complete the power delivery circuit. This can be a float type switch akin to a commode fill up valve or it can use the presence of water or other well fluids to otherwise complete a circuit. Since it is generally known at what depth the plug 18 has been set, the tool 26 can be quickly lowered to the approximate vicinity and then its speed reduced to avoid getting the lower end buried in the sand 24. The control system can also incorporate a flow switch to detect plugging in the debris tool 40 and shut the pump 38 to avoid ruining it or burning up the motor 36 if the pump 38 plugs up or stops turning for any reason. Other aspects of the control system 32 can include the ability to transmit electromagnetic or pressure wave signals through the wellbore or the slickline 28 such information such as the weight or volume of collected debris, for example.

Figure 3:
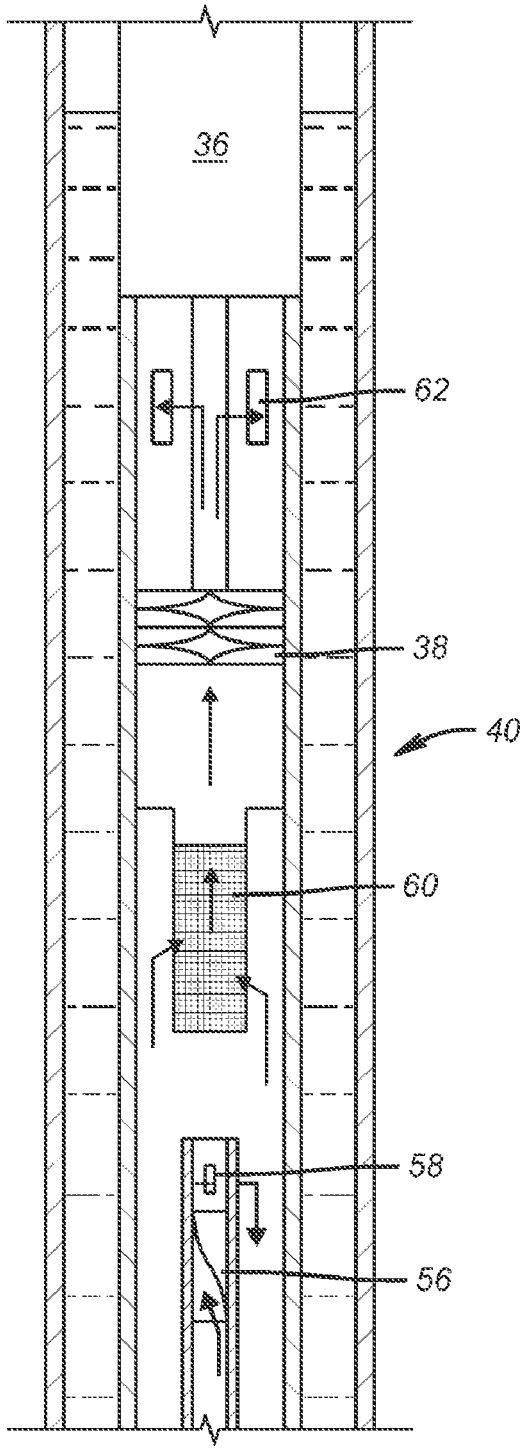
FIG. 3 is a detailed view of the debris removal device shown in FIG. 2.
Figure 4:
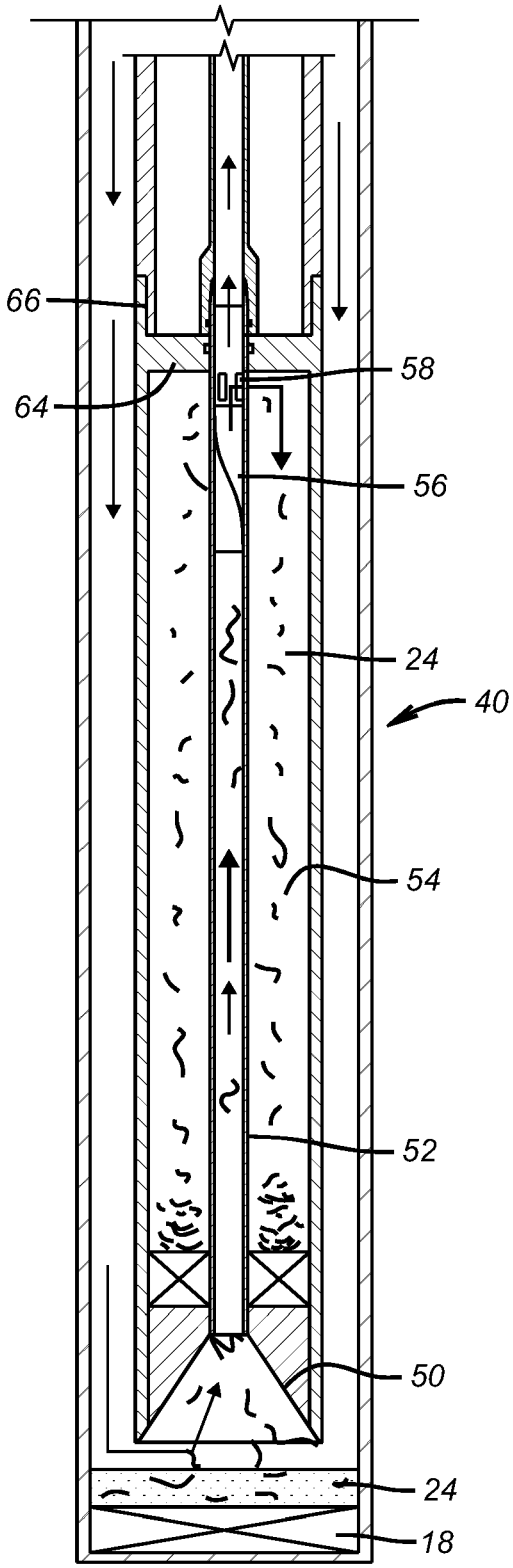
FIG. 4 is a lower end view of the device in FIG. 3 and illustrating the modular capability of the design.

Referring now to FIGS. 3 and 4, the inner details of the debris removal tool 40 are illustrated. There is a tapered inlet 50 leading to a preferably centered lift tube 52 that defines an annular volume 54 around it. Tube 52 can have one or more centrifugal separators 56 inside whose purpose is to get the fluid stream spinning to get the solids to the inner wall using centrifugal force. Alternatively, the tube 52 itself can be a spiral so that flow through it at a high enough velocity to keep the solids entrained will also cause them to migrate to the inner wall until the exit ports 58 are reached. Some of the sand or other debris will fall down in the annular volume 54 where the fluid velocity is low or non-existent. As best shown in FIG. 3, the fluid stream ultimately continues to a filter or screen 60 and into the suction of pump 38. The pump discharge exits at ports 62.

As shown in FIG. 4 the design can be modular so that tube 52 continues beyond partition 64 at thread 66 which defines a lowermost module. Thereafter, more modules can be added within the limits of the pump 38 to draw the required flow through tube 52. Each module has exit ports 58 that lead to a discrete annular volume 54 associated with each module. Additional modules increase the debris retention capacity and reduce the number of trips out of the well to remove the desired amount of sand 24.

Various options are contemplated. The tool 40 can be triggered to start when sensing the top of the layer of debris, or by depth in the well from known markers, or simply on a time delay basis. Movement uphole of a predetermined distance can shut the pump 38 off. This still allows the slickline operator to move up and down when reaching the debris so that he knows he's not stuck. The tool can include a vibrator to help fluidize the debris as an aid to getting it to move into the inlet 50. The pump 38 can be employed to also create vibration by eccentric mounting of its impeller. The pump can also be a turbine style or a progressive cavity type pump.

The tool 40 has the ability to provide continuous circulation which not only improves its debris removal capabilities but can also assist when running in or pulling out of the hole to reduce chances of getting the tool stuck.

While the preferred tool is a debris catcher, other tools can be run in on cable or slickline and have an on board power source for accomplishing other downhole operations. FIG. 2 is intended to schematically illustrate other tools 40 that can accomplish other tasks downhole such as honing or light milling. To the extent a torque is applied by the tool to accomplish the task, a part of the tool can also include an anchor portion to engage a well tubular to resist the torque applied by the tool 40. The slips or anchors that are used can be actuated with the on board power supply using a control system that for example can be responsive to a pattern of uphole and downhole movements of predetermined length to trigger the slips and start the tool.

Figure 5:
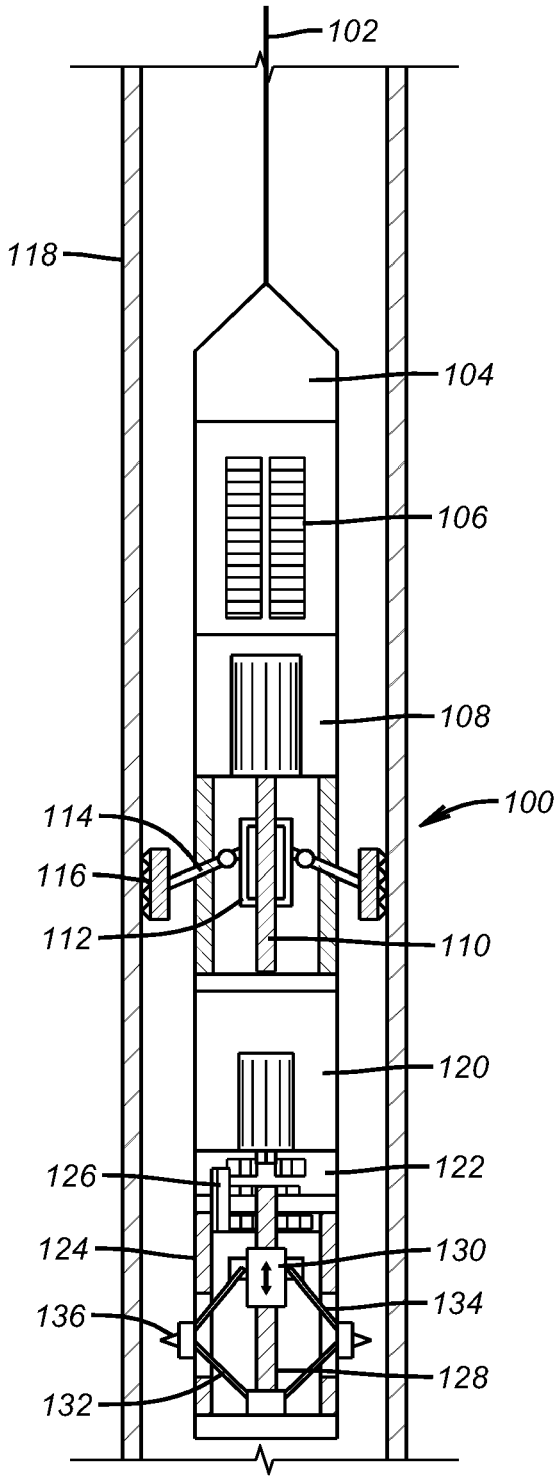
FIG. 5 is another application of a tool run on slickline to cut tubulars.

FIG. 5 illustrates a tubular cutter 100 run in on slickline 102. On top is a control package 104 that is equipped to selectively start the cutter 100 at a given location that can be based on a stored well profile in a processor that is part of package 104. There can also be sensors that detect depth from markers in the well or there can more simply be a time delay with a surface estimation as to the depth needed for the cut. Sensors could be tactile feelers, spring loaded wheel counters or ultrasonic proximity sensors. A battery pack 106 supplies a motor 108 that turns a ball shaft 110 which in turn moves the hub 112 axially in opposed directions. Movement of hub 112 rotates arms 114 that have a grip assembly 116 at an outer end for contact with the tubular 118 that is to be cut. A second motor 120 also driven by the battery pack 106 powers a gearbox 122 to slow its output speed. The gearbox 122 is connected to rotatably mounted housing 124 using gear 126. The gearbox 122 also turns ball screw 128 which drives housing 130 axially in opposed directions. Arms 132 and 134 link the housing 130 to the cutters 136. As arms 132 and 134 get closer to each other the cutters 136 extend radially. Reversing the rotational direction of cutter motor 120 retracts the cutters 136.

When the proper depth is reached and the anchor assemblies 116 get a firm grip on the tubular 118 to resist torque from cutting, the motor 120 is started to slowly extend the cutters 136 while the housing 124 is being driven by gear 126. When the cutters 136 engage the tubular 118 the cutting action begins. As the housing 124 rotates to cut the blades are slowly advanced radially into the tubular 118 to increase the depth of the cut. Controls can be added to regulate the cutting action. They controls can be as simple as providing fixed speeds for the housing 124 rotation and the cutter 136 extension so that the radial force on the cutter 136 will not stall the motor 120. Knowing the thickness of the tubular 118 the control package 104 can trigger the motor 120 to reverse when the cutters 136 have radially extended enough to cut through the tubular wall 118. Alternatively, the amount of axial movement of the housing 130 can be measured or the number of turns of the ball screw 128 can be measured by the control package 104 to detect when the tubular 118 should be cut all the way through. Other options can involve a sensor on the cutter 136 that can optically determine that the tubular 118 has been cut clean through. Reversing rotation on motors 108 and 120 will allow the cutters 136 to retract and the anchors 116 to retract for a fast trip out of the well using the slickline 102.

Figure 6:
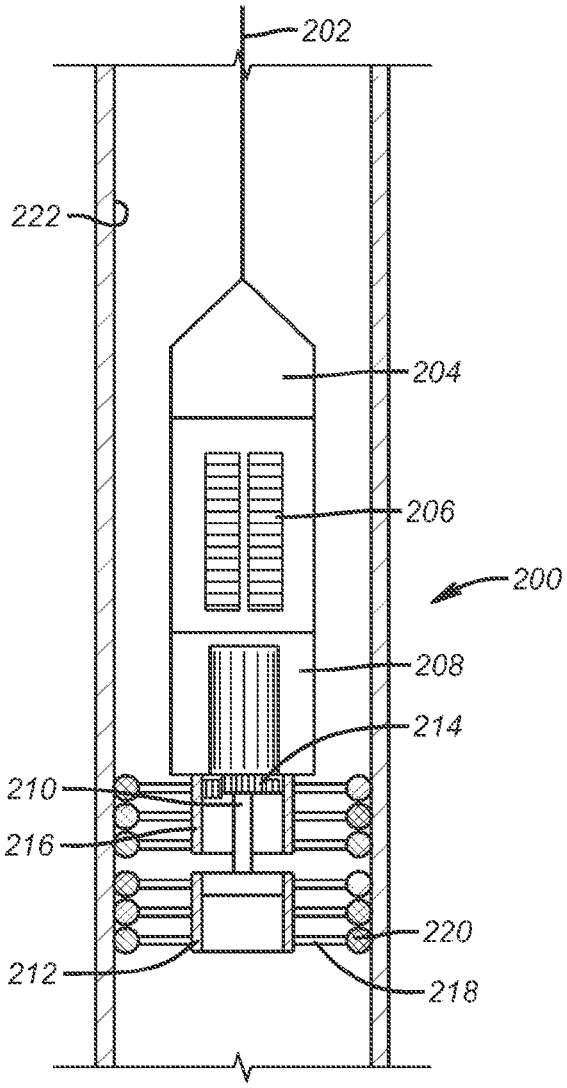
FIG. 6 is another application of a tool to scrape tubulars without an anchor that is run on slickline.
Figure 7:
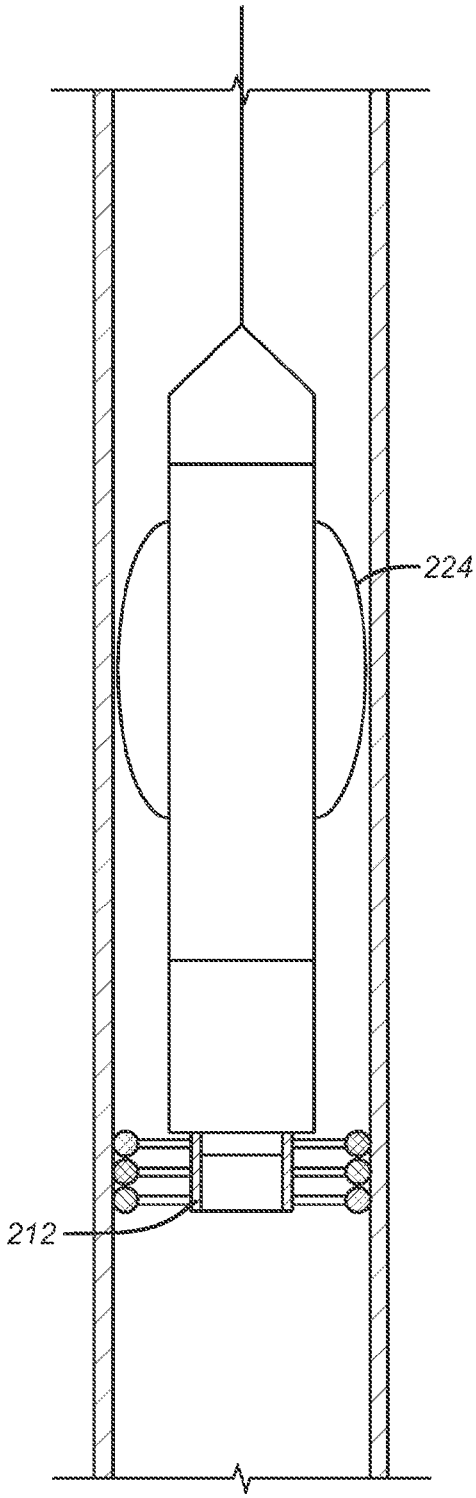
FIG. 7 is an alternative embodiment of the tool of FIG. 6 showing an anchoring feature used without the counter-rotating scrapers in FIG. 6.
Figure 8:
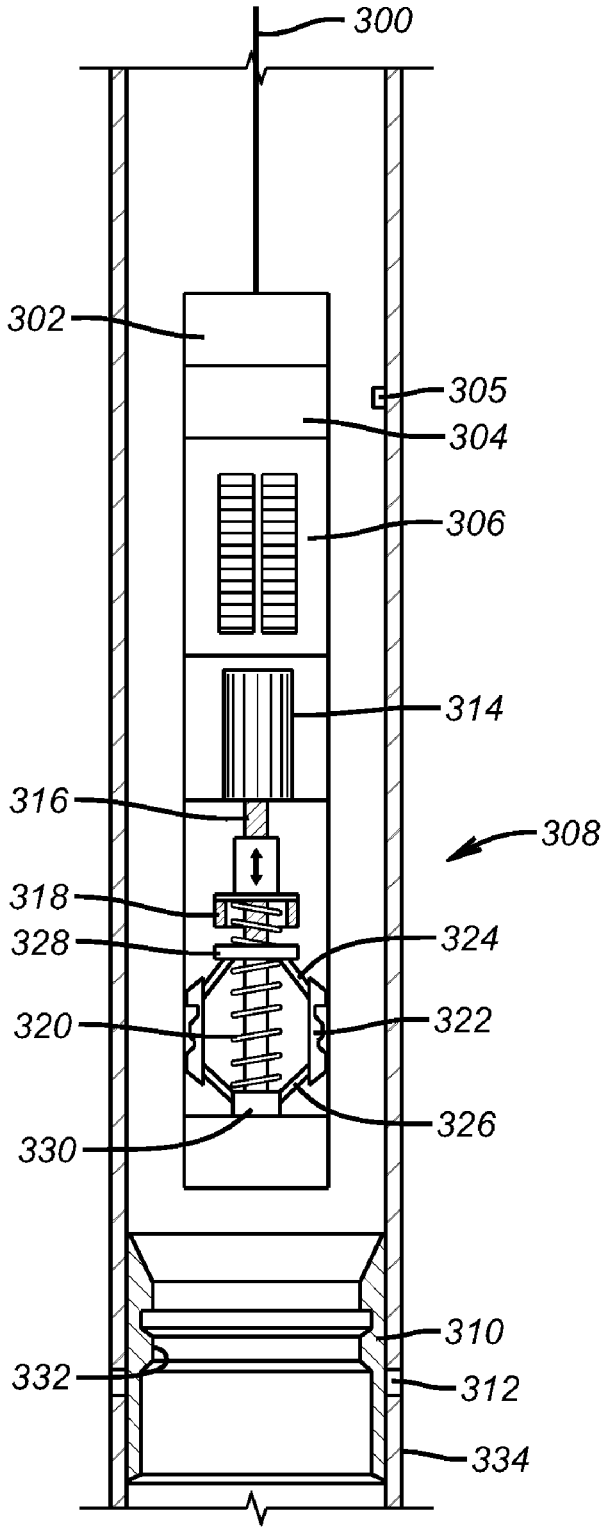
FIG. 8 is a section view showing a slickline run tool used for moving a downhole component.

FIG. 6 illustrates a scraper tool 200 run on slickline 202 connected to a control package 204 that can in the same way as the package 104 discussed with regard to the FIG. 5 embodiment, selectively turn on the scraper 200 when the proper depth is reached. A battery pack 206 selectively powers the motor 208. Motor shaft 210 is linked to drum 212 for tandem rotation. A gear assembly 214 drives drum 216 in the opposite direction as drum 212. Each of the drums 212 and 216 have an array of flexible connectors 218 that each preferably have a ball 220 made of a hardened material such as carbide. There is a clearance around the extended balls 220 to the inner wall of the tubular 222 so that rotation can take place with side to side motion of the scraper 200 resulting in wall impacts on tubular 222 for the scraping action. There will be a minimal net torque force on the tool and it will not need to be anchored because the drums 212 and 216 rotate in opposite directions. In the alternative, there can be but a single drum 212 as shown in FIG. 7. In that case the tool 200 needs to be stabilized against the torque from the scraping action. One way to anchor the tool is to use selectively extendable bow springs 224 that are preferably retracted for run in with slickline 202 so that the tool can progress rapidly to the location that needs to be scraped. Other types of driven extendable anchors could also be used and powered to extend and retract with the battery pack 206. The scraper devices 220 can be made in a variety of shapes and include diamonds or other materials for the scraping action.

Figure 9:
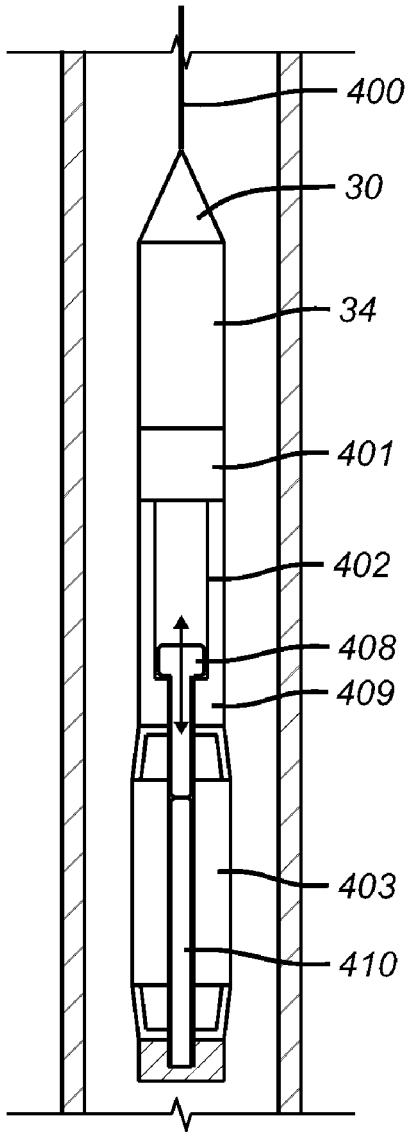
FIG. 9 is an alternative embodiment to the tool in FIG. 8 using a linear motor to set a packer.

FIG. 9 shows using a slickline 400 conveyed motor to set a mechanical packer 403. The tool 400 includes a disconnect 30, a battery 34, a control unit 401 and a motor unit 402. The motor unit can be a linear motor, a motor with a power screw or any other similar arrangements. When motor is actuated, the center piston or power screw 408 which is connected to the packer mandrel 410 moves respectively to the housing 409 against which it is braced to set the packer 403.

Figure 10:
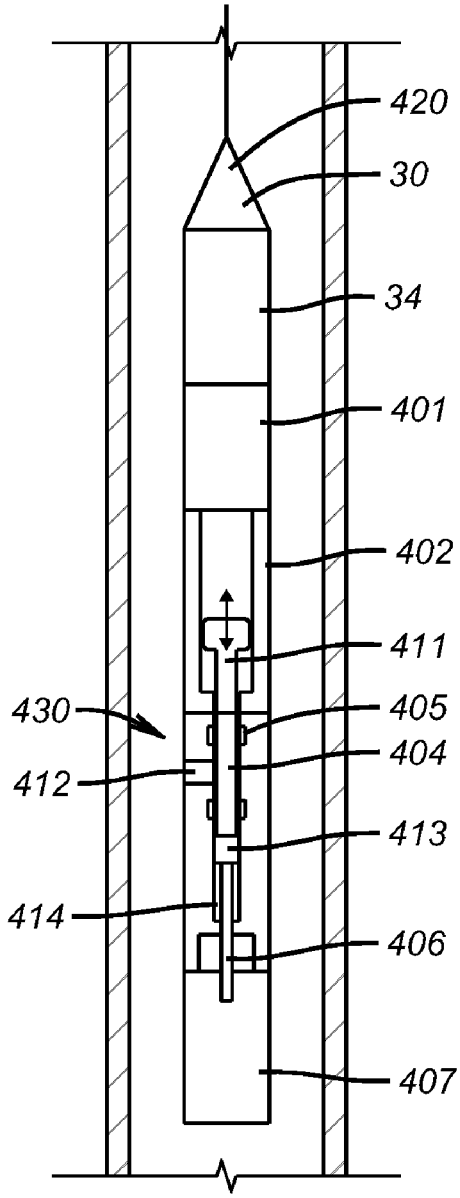
FIG. 10 is an alternative to FIG. 9 that incorporates hydrostatic pressure to set a packer.

In another arrangement, as illustrated in FIG. 10, a tool such as a packer or a bridge plug is set by a slickline conveyed setting tool 430. The tool 430 also includes a disconnect 30, a battery 34, a control unit 401 and a motor unit 402. The motor unit 402 also can be a linear motor, a motor with a power screw or other similar arrangements. The center piston or power screw 411 is connected to a piston 404 which seals off using seals 405 a series of ports 412 at run in position. When the motor is actuated, the center piston or power screw 411 moves and allow the ports 412 to be connected to chamber 413. Hydrostatic pressure enters the chamber 413, working against atmosphere chamber 414, pushing down the setting piston 413 and moving an actuating rod 406. A tool 407 thus is set.

Figure 11:
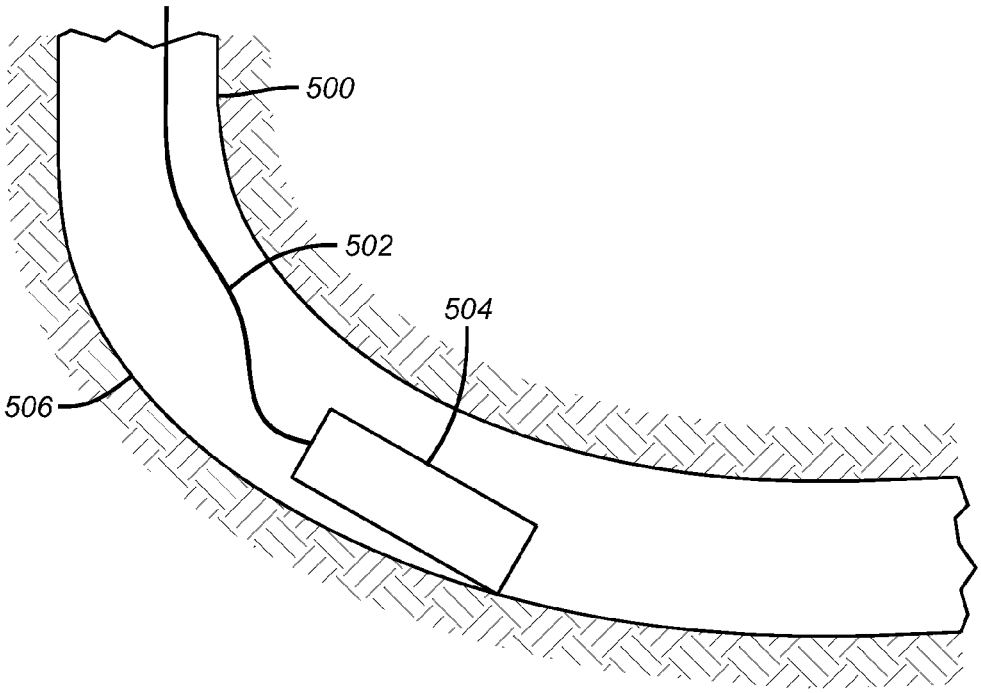
(PRIOR ART) FIG. 11
FIG. 11 illustrates the problem with using slicklines when encountering a wellbore that is deviated.

FIG. 11 illustrates a deviated wellbore 500 and a slickline 502 supporting a bottom hole assembly that can include logging tools or other tools 504. When the assembly 504 hits the deviation 506, forward progress stops and the cable goes slack as a signal on the surface that there is a problem downhole. When this happens, different steps have been taken to reduce friction such as adding external rollers or other bearings or adding viscosity reducers into the well. These systems have had limited success especially when the deviation is severe limiting the usefulness of the weight of the bottom hole assembly to further advance downhole.

Figure 12:
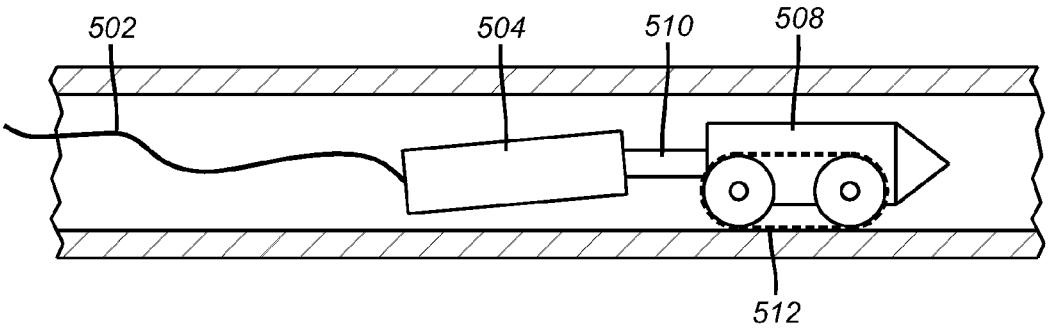
FIG. 12 illustrates how tractors are used to overcome the problem illustrated in FIG. 11.

FIG. 12 schematically illustrates the slickline 502 and the bottom hole assembly 504 but this time there is a tractor 508 that is connected to the bottom hole assembly (BHA) by a hinge or swivel joint or another connection 510. The tractor assembly 508 has onboard power that can drive wheels or tracks 512 selectively when the slickline 502 has a detected slack condition. Although the preferred location of the tractor assembly is ahead or downhole from the BHA 504 and on an end opposite from the slickline 502 placement of the tractor assembly 508 can also be on the uphole side of the BHA 504. At that time the drive system schematically represented by the tracks 512 starts up and drives the BHA 504 to the desired destination or until the deviation becomes slight enough to allow the slack to leave the slickline 502. If that happens the drive system 512 will shut down to conserve the power supply, which in the preferred embodiment will be onboard batteries. The connection 510 is articulated and is short enough to avoid binding in sharp turns but at the same time is flexible enough to allow the BHA 504 and the tractor 508 to go into different planes and to go over internal irregularities in the wellbore. It can be a plurality of ball and socket joints that can exhibit column strength in compression, which can occur when driving the BHA out of the wellbore as an assist to tension in the slickline. When coming out of the hole in the deviated section, the assembly 508 can be triggered to start so as to reduce the stress in the slickline 502 but to maintain a predetermined stress level to avoid overrunning the surface equipment and creating slack in the cable that can cause the cable 502 to ball up around the BHA 504. Ideally, a slight tension in the slickline 502 is desired when coming out of the hole. The mechanism that actually does the driving can be retractable to give the assembly 508 a smooth exterior profile where the well is not substantially deviated so that maximum advantage of the available gravitational force can be taken when tripping in the hole and to minimize the chances to getting stuck when tripping out. Apart from wheels 512 or a track system other driving alternatives are envisioned such a spiral on the exterior of a drum whose center axis is aligned with the assembly 508. Alternatively the tractor assembly can have a surrounding seal with an onboard pump that can pump fluid from one side of the seal to the opposite side of the seal and in so doing propel the assembly 508 in the desired direction. The drum can be solid or it can have articulated components to allow it to have a smaller diameter than the outer housing of the BHA 504 for when the driving is not required and a larger diameter to extend beyond the BHA 504 housing when it is required to drive the assembly 508. The drum can be driven in opposed direction depending on whether the BHA 504 is being tripped into and out of the well. The assembly 510 could have some column strength so that when tripping out of the well it can be in compression to provide a push force to the BHA 504 uphole such as to try to break it free if it gets stuck on the trip out of the hole. This objective can be addressed with a series of articulated links with limited degree of freedom to allow for some column strength and yet enough flexibility to flex to allow the assembly 508 to be in a different plane than the BHA 504. Such planes can intersect at up to 90 degrees. Different devices can be a part of the BHA 504 as discussed above. It should also be noted that relative rotation can be permitted between the assembly 508 and the BHA 504 which is permitted by the connector 510. This feature allows the assembly to negotiate a change of plane with a change in the deviation in the wellbore more easily in a deviated portion where the assembly 508 is operational.

The above description is illustrative of the preferred embodiment and many modifications may be made by those skilled in the art without departing from the invention whose scope is to be determined from the literal and equivalent scope of the claims below:

We claim:

1. A debris collection assembly for downhole use, comprising:

a housing and a slickline to support said housing downhole;

a pump operated by a power supply in said housing, said pump providing continuous circulation through said housing between an inlet and an outlet to said housing;

a debris collection volume in said housing positioned outside a flow path through said housing between said inlet and said outlet;

a control system in said housing to selectively operate said pump, said control system selectively turning off the pump when said housing is moved uphole a predetermined distance.

2. The assembly of claim 1, comprising:

an inlet tube for incoming debris carried by fluid, said inlet tube extending from said inlet and further comprising at least one opening to said debris collection volume.

3. The assembly of claim 2, comprising:

a screen in said housing through which fluid exiting said inlet tube flows before reaching said pump.

4. The assembly of claim 2, comprising:

a static mixer in said inlet tube to impart a swirl to debris laden fluid flowing through said inlet tube.

5. The assembly of claim 2, wherein:

said housing comprises a plurality of modules each having an inlet tube with an opening to said debris collection volume and where fluid flow continues from one inlet tube to the next before reaching said pump.

6. The assembly of claim 5, wherein:

debris separated from fluid in a given module stays in that module.

7. The assembly of claim 1, comprising:

said control system starts said pump with a time delay or a sensing of depth in the wellbore.

8. The assembly of claim 1, comprising:

a vibrator on said housing to agitate debris adjacent said inlet.

* * * * *